US005123209A

United States Patent [19]

Nally

[11] Patent Number: 5,123,209

[45] Date of Patent: Jun. 23, 1992

[54] EARTH ENGINEERING APPARATUS AND METHOD

[76] Inventor: W. T. Nally, 2407 Warburton Rd., Charlotte, N.C. 28211

[21] Appl. No.: 625,276

[22] Filed: Dec. 7, 1990

[51] Int. Cl.[5] ..... E02D 5/00

[52] U.S. Cl. ..... 52/165; 405/230; 405/229; 52/170; 52/155; 175/314

[58] Field of Search ..... 52/155, 156, 158, 165, 52/170, 173; 175/19, 21, 162, 314; 166/285; 405/230

[56] References Cited

U.S. PATENT DOCUMENTS

| | | | |
|---|---|---|---|
| 767,209 | 8/1904 | Decker | 175/314 |
| 2,982,103 | 1/1959 | Revesz et al. | 405/230 |
| 3,852,970 | 12/1974 | Cassidy | 405/230 |
| 5,013,190 | 5/1991 | Green | 405/230 |

*Primary Examiner*—Richard E. Chilcot, Jr.
*Assistant Examiner*—Wynn E. Wood
*Attorney, Agent, or Firm*—Ralph H. Dougherty

[57] ABSTRACT

The apparatus includes a shelf-like bracket which mounts to the exposed foundation of a building or other structure. The portion of the bracket which fits underneath the foundation is adjustable to permit secure fitting. The bracket includes a vertically mounted cylindrical member adapted for receiving and holding piers (pipes). A first housing is mounted vertically atop the bracket and is adapted to support a hydraulic cylinder for driving piers into the subsurface surrounding the foundation. Each pier is adequately secured to a preceding pier prior to being driven into the subsurface. Connected piers are consecutively driven into the subsurface to a predetermined point. The first housing is removed and a second driving device is used to drive the piers further into the subsurface. Grout is forced by pressure through the interior of the piers and out through the base pier's apertures, thereby forming a grout base at the base of the piers. A second housing is mounted vertically atop the bracket and is adapted to support a hydraulic cylinder for lifting (and lowering) the foundation to a predetermined point. A collar is secured to the driven piers and positioned beneath the cylindrical member of the bracket. The collar locks the bracket into place and further secures the foundation. The exposed foundation is then backfilled. Multiple apparati are preferably positioned at advantageous points around the structure.

25 Claims, 6 Drawing Sheets 46
10
12
14
30
16
62
64
X
18
29
49

EARTH ENGINEERING APPARATUS AND METHOD

BACKGROUND OF THE INVENTION

1. Field of the Invention

The present invention relates generally to earth engineering, and more particularly to an apparatus and method for supporting and/or raising a structure, such as a building or house, and the like.

2. Description of Related Art

Structures erected on the surface of the earth are subject to "settling" if constructed on unstable soil conditions. Settling typically causes the structure, as a whole, to be uneven relative to horizontal plane of the earth. In addition, settling may cause structural damage to the foundation of the structure and the structure itself. Consequently it has proven useful to devise ways to protect against settling and to provide a remedy in the event of settling.

Prior attempts to provide apparati and methods to solve the problem suffer several disadvantages. The typical approach is to drive a number of connected pipe sections into the ground adjacent to the structure and to then affix the uppermost end of the pipe sections to the foundation of the structure. A number of systems are directed toward shoring a foundation but do not provide for lifting of a settled foundation. Other systems provide no means for ensuring that driven pipes do not themselves settle at some future time.

The applicant is aware of the following U.S. Patents, which relate generally to methods and apparati for reinforcing and raising foundations:

| U.S. PAT. NO. | INVENTOR | ISSUE DATE | TITLE |
|---|---|---|---|
| 1,906,136 | DAHREN | 4/25/33 | METHOD OF DRIVING PILE SHELLS |
| 2,789,419 | PICKMAN | 4/23/57 | METHOD FOR FORMING REINFORCED FOUNDATION PILES WITH AN ENLARGED BASE |
| 2,853,858 | MINTZ | 9/30/58 | METHOD OF STABILIZING FOUNDATIONS |
| 2,982,103 | REVESZ | 5/2/61 | METHOD AND APPARATUS FOR UNDERPINNING A BUILDING |
| 3,779,025 | GODLEY et al. | 12/18/73 | PILE INSTALLATION |
| 3,796,055 | MAHONY | 3/12/74 | METHOD AND APPARATUS FOR UNDERPINNING AND RAISING A BUILDING FOUNDATION |
| 3,902,326 | LANGENBACH, JR. | 9/2/75 | APPARATUS FOR AND METHOD OF SHORING A FOUNDATION |
| 4,338,047 | DAVID | 7/6/82 | SYSTEM FOR PIER UNDERPINNING OF SETTLING FOUNDATION |
| 4,548,526 | BULLIVANT | 10/22/85 | PILING METHOD |
| 4,591,466 | MURRAY | 5/27/86 | METHOD FOR POSITIONING AND STABILIZING A CONCRETE SLAB |
| 4,634,319 | MAY | 1/6/87 | METHOD AND APPARATUS FOR LIFTING AND SUPPORTING STRUCTURES |
| 4,673,315 | SHAW et al. | 1/16/87 | APPARATUS FOR RAISING AND SUPPORTING A BUILDING |
| 4,678,373 | LANGENBACH, JR. | 7/7/87 | APPARATUS FOR AND METHOD OF SHORING A STRUCTURE |
| 4,695,203 | GREGORY | 9/22/87 | METHOD AND APPARATUS FOR SHORING AND SUPPORTING A BUILDING FOUNDATION |
| 4,708,528 | RIPPE | 11/24/87 | PROCESS AND APPARATUS FOR STABILIZING FOUNDATION |
| 4,765,777 | GREGORY | 8/23/88 | APPARATUS AND METHOD FOR RAISING AND SUPPORTING A BUILDING |

-continued

| U.S. PAT. NO. | INVENTOR | ISSUE DATE | TITLE |
|---|---|---|---|
| 4,907,916 | HARTMAN | 3/13/90 | PRESSURE GROUTED PIER AND PIER INSERTING TOOL |

Dahren relates to a method for driving down supporting piles intended for buildings or the like, and does not relate to raising a structure.

Pickman relates to a method and a device for forming foundation piles from reinforced concrete or the like which are provided with an enlarged base molded in the ground. Pickman does not relate to raising a structure.

Mintz relates generally to means for and method of stabilizing foundations of houses and buildings when, because of sub-soil settlement, failure of foundations occur.

Revesz relates to a method and apparatus for underpinning a building in which the building load is transferred to a supporting structure to prevent further settlement.

Godley et al. relates to the formation and driving of piles and more particularly, it concerns pile constructions which facilitate installation and bearing. Godley fills a driven hollow tube with flowable castable material and allows the material to harden before completing the pile driving process. No external grout bulb is formed.

Mahony pertains to a method and apparatus for underpinning and raising building foundations as, for example, where the soil has failed to maintain support of the building as may be caused by various circumstances.

Langenbach, Jr. (U.S. Pat. No. 3,902,326) relates to the apparatus for and a method of shoring the foundation of a building, and more particularly to such apparatus and method in which the shored foundation is directly supported by load supporting underground strata.

David relates generally to the shoring of foundations, and more specifically pertains to a method and arrangement of components for providing pier underpinning of settling foundations.

Bullivant concerns a piling method for providing piles beneath a previously built building which has been unstable.

Murray relates to means for positioning a slab and supporting it in the desired elevational position.

May relates to a system designed to lift and support structures, particularly buildings and the like which may have settled from their original desired position and need to be righted or leveled.

Shaw et al. relates to an apparatus and method for raising and supporting a building, and more particularly to such an apparatus and method in which pilings are used to support the foundations or concrete slab of a building.

Langenbach, Jr. (U.S. Pat. No. 4,678,373) relates generally to apparatus for and a method of shoring structures, such as foundations, and more particularly to such apparatus and method which effects such shoring by driving a pile down into the ground adjacent the structure to be shored.

Gregory (U.S. Pat. No. 4,695,203) relates to a method and apparatus for supporting and shoring building foundations and more particularly to a means for raising and supporting structural walls that have recessed due to shifting and/or weak supporting strata.

Rippe relates in general to foundations for building and similar structures, and more particularly to an apparatus and process for shoring such foundations.

Gregory (4,765,777) relates to an apparatus and method for raising and supporting a building, and more particularly to such an apparatus and method in which pilings are used to support the foundation or concrete slab of a building.

Hartman relates to an apparatus used for shoring building and other foundations, to a pressure grouted pier and to the method of forming that pier under such a foundation so as to add new support. Hartman does not relate to lifting of structures.

The related art does not appear to disclose the structure, operation, and result of the present invented method and apparatus. None of the related art discloses an apparatus and method for supporting and orienting a structure which include the elements described herein.

SUMMARY OF THE INVENTION

The apparatus includes a shelf-like bracket which mounts onto the exposed foundation of a building or other structure. The portion of the bracket which fits underneath the foundation is adjustable to permit secure fitting. The bracket includes a vertically mounted cylindrical member adapted for receiving and holding pipes (or piers). "Pier", as used herein, means a load-bearing support device capable of being driven into the earth to a desired depth. A first housing is mounted vertically atop the bracket and is adapted to support a hydraulic cylinder or other means for driving piers into the subsurface surrounding the foundation. Preferably, the initial pier has a closed, tapered or pointed end which facilitates entry into the subsurface, and has apertures on the walls of the pier. Each pier is adequately secured end-to-end to a preceding pier prior to being driven into the subsurface. Connected piers are consecutively driven into the subsurface to a point of "first refusal", that is, to a point where the piers refuse to be driven further. The first housing is removed from the bracket and a driving device is employed to drive the piers further into the subsurface to the point of final refusal. As used herein, the point of "final refusal" is that point where reasonable attempts to drive the piers further into the ground do not result in any appreciable increase in depth, which typically means that load-bearing underground strata such as bedrock has been encountered. Grout is forced by pressure through the interior of the piers and out through the base pier's apertures, thereby forming a grout base at the base of the piers. "Grout", as used herein, means any liquid or semi-solid capable of hardening to form a support within the subsurface of the earth, such as cementitious matter. A second housing is mounted vertically atop the bracket and is adapted to support a hydraulic cylinder for lifting (and/or lowering) the foundation to a desired height. A collar is secured to the driven pipes and positioned beneath the cylindrical member of the bracket. The collar locks the bracket into place and consequently secures the foundation. The exposed foundation is then backfilled. Multiple apparati are preferably positioned at selected points around the structure.

OBJECTS OF THE INVENTION

The principal object of the invention is to provide an apparatus and method for supporting and orienting a structure such as a building or house.

Another object of the invention is to provide an apparatus and method for leveling a structure that has become uneven due to settlement of subsurface soil.

A further object of the invention is to provide an apparatus and method which provides increased stability to a structure by forming a grout base at the base of a set of driven piers affixed to the structure.

A further object of the invention is to provide an bracket capable of adjustably mounting to the foundation of a structure.

BRIEF DESCRIPTION OF THE DRAWINGS

The foregoing and other objects will become more readily apparent by referring to the following detailed description and the appended drawings, in which.

DETAILED DESCRIPTION

Figure 1:
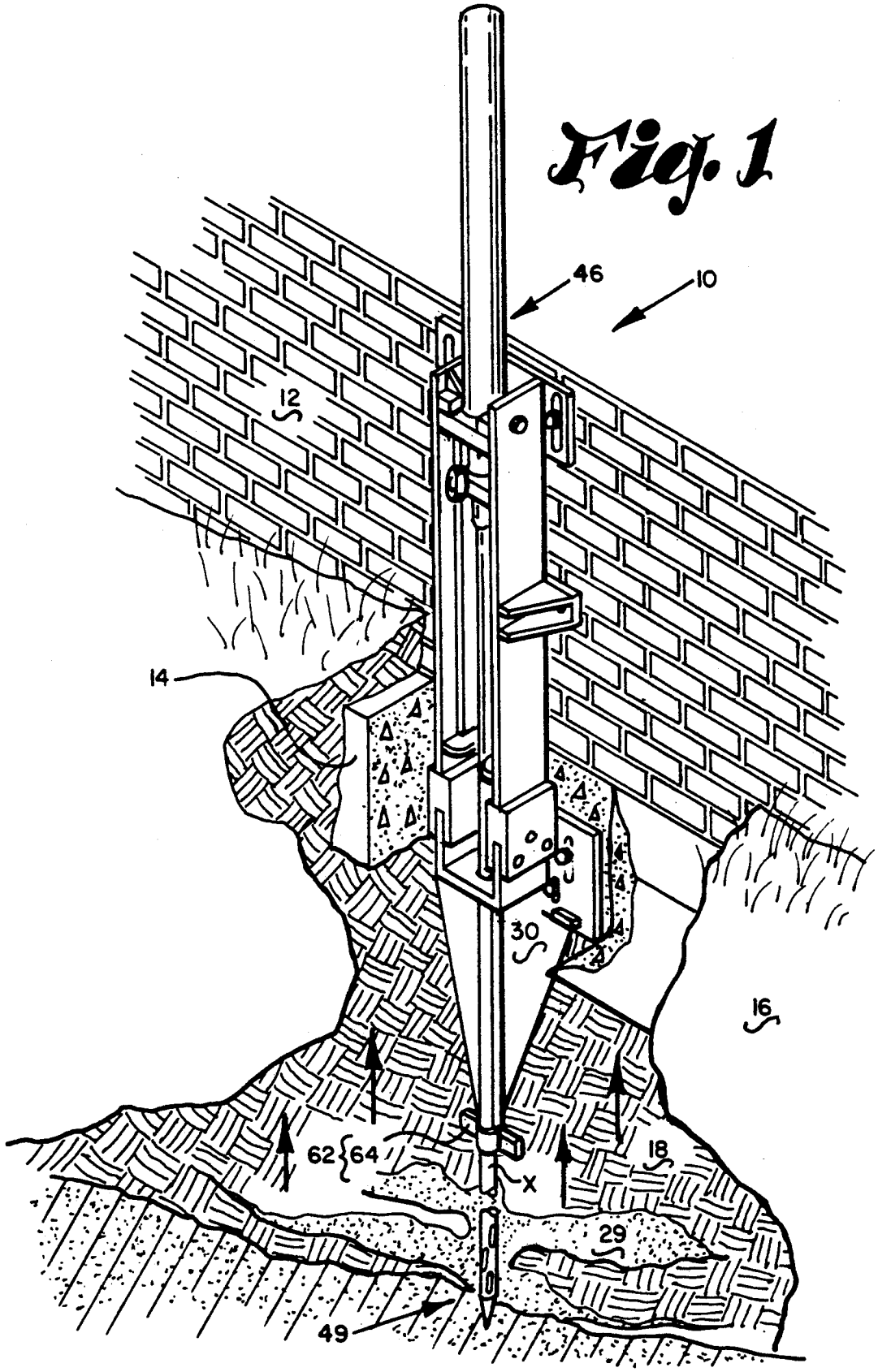
FIG. 1 is a perspective view of the invented earth engineering apparatus mounted on the foundation of a structure, illustrating, by broken view, "heaving" of the earth as the result of pressure grouting.

Referring now to the drawings, and particularly to FIG. 1, there is shown the invented apparatus 10 for supporting and orienting a structure 12 having a foundation 14 on a surface 16 having a subsurface 18.

Figures 11, 12, 15:
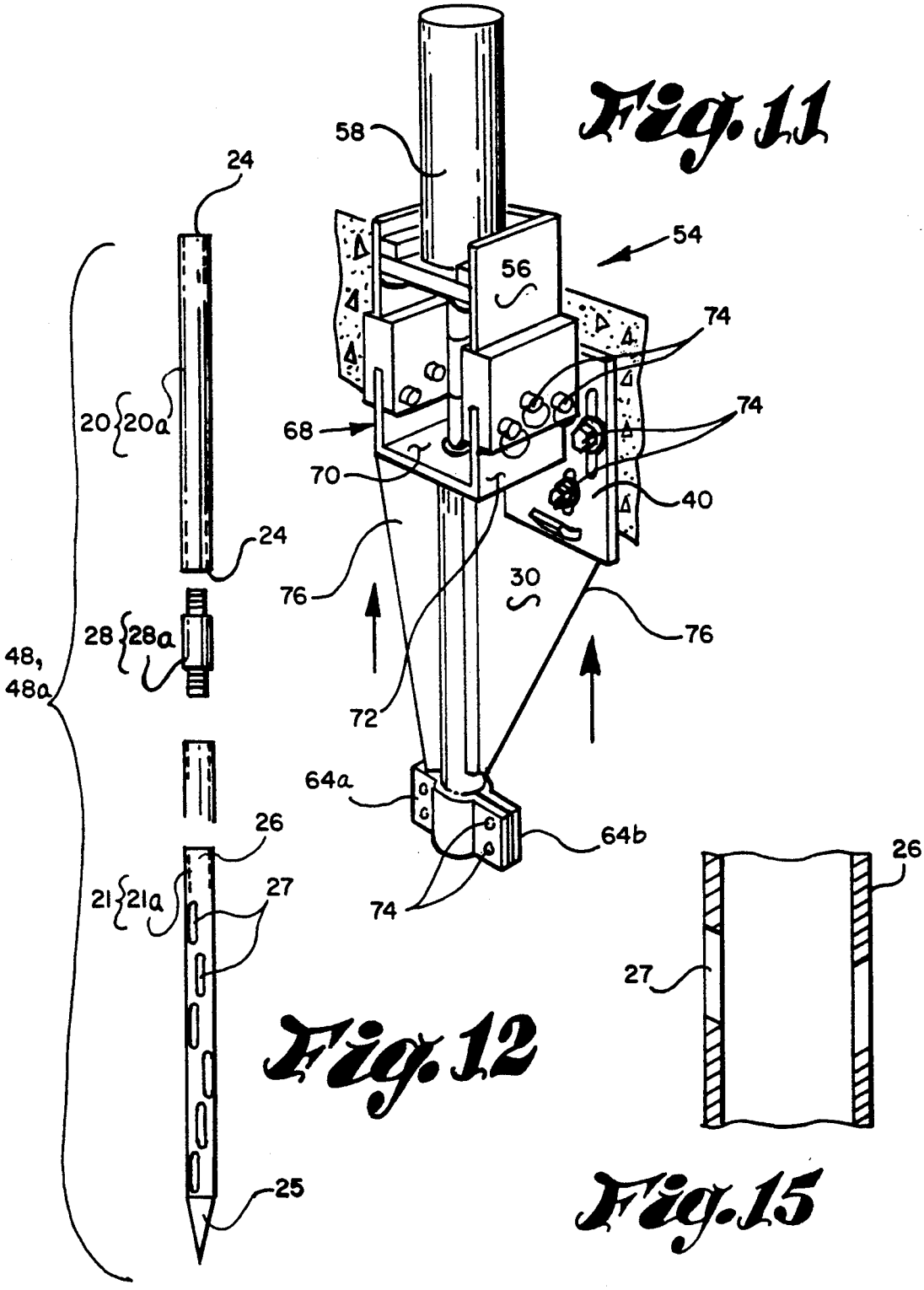
FIG. 11 is a perspective view of the bracket with the second housing attached thereto, illustrating the orienting means assembly.
FIG. 12 is an exploded view of the initial pier having a tapered end and side wall apertures, an adjacent pier, and a connector piece.

At least one drivable member 20, preferably a set of piers 20*a*, is provided, as shown in FIG. 12. Each drivable member 20 defines a generally tubular structure having a hollow interior 22 that is open at both ends 24. Each end 24 is threaded and a connector piece 28*a* having mating threads provides means 28 for coupling an end 24 of a drivable member 20 with an end of another drivable member 20. The drivable member 21 which is to be driven first and lowermost has a closed, tapered or pointed end 25 for facilitating entry into the subsurface 18. The intended lowermost drivable member 21 also has walls 26 defining apertures 27 therein for conveying grout 29 from within the hollow interior 22 to the subsurface 18.

Figure 6:
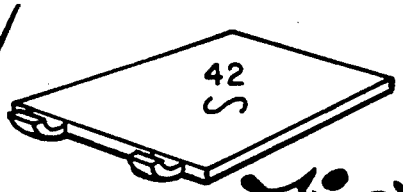
FIG. 6 is a perspective view of the horizontal member, which is adjustably connectable to the vertical member illustrated in FIG. 7, for engagement with the underside of the foundation.
Figure 7:
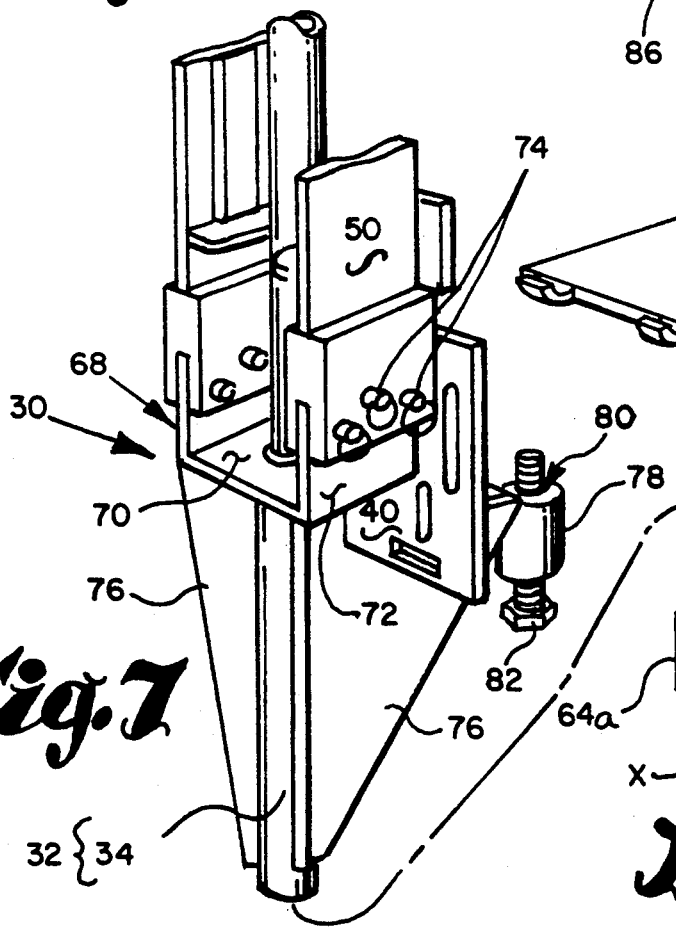
FIG. 7 is a perspective view of a bracket with the first housing attached thereto, illustrating the vertical member adjustably connectable the horizontal member shown in FIG. 6, and associated adjustment means.

A bracket 30, the preferred embodiment of which is shown in FIGS. 6 and 7, is adapted for mounting on the foundation 14. The bracket 30 has means 32 for slidably engaging the drivable members 20 and for positioning the drivable members 20 generally normal to the surface 16. Engaging means 32 preferably include a cylindrical member 34 vertically mounted to the bracket 30.

Figure 13:
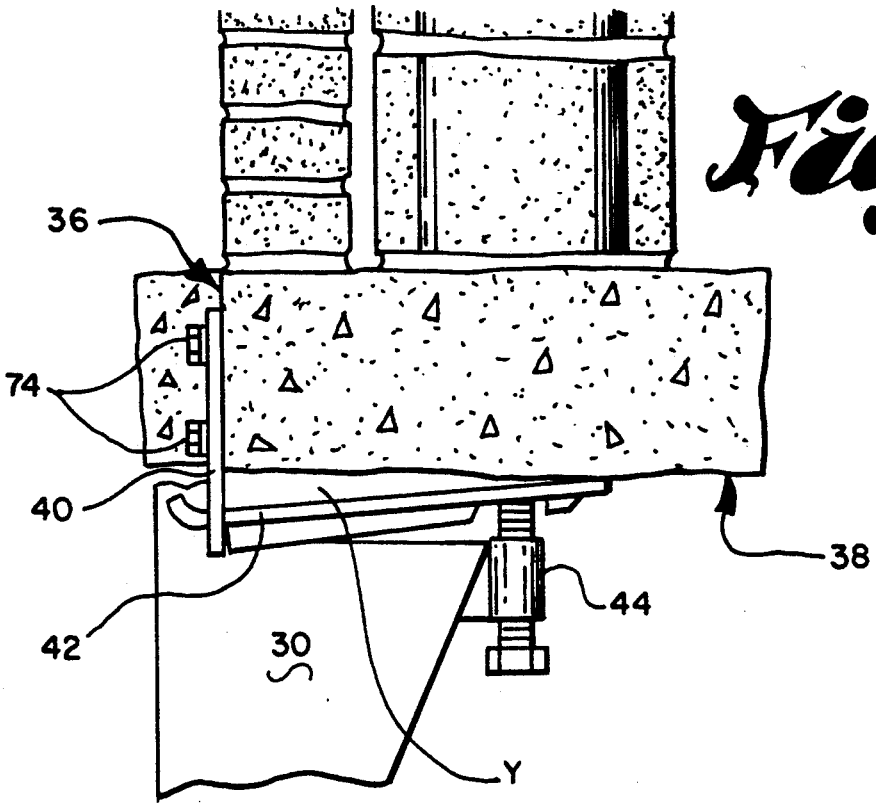
FIG. 13 is an exposed side view of the bracket mounted to a foundation, illustrating the horizontal member engaged with a portion of the underside of the foundation.
Figure 14:
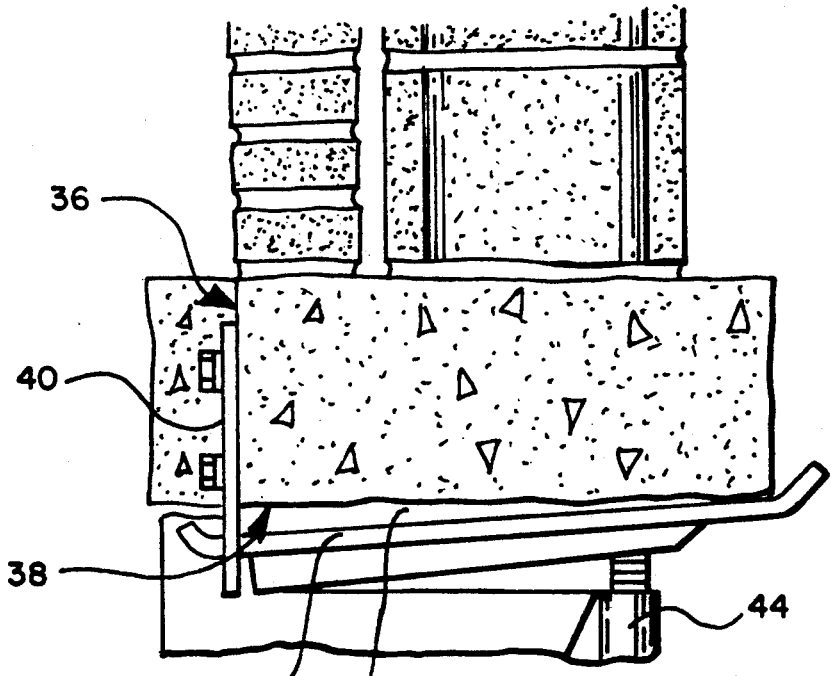
FIG. 14 is an exposed side view of the bracket mounted to a foundation, illustrating an extended horizontal member engaged with the underside of the foundation.

The foundation 14 includes a generally vertically oriented face portion 36 and a generally horizontally oriented bottom portion 38 adjacent to the vertically oriented face portion 36. See FIGS. 13 and 14. The bracket 30 includes a housing mating section 68 mounted atop the cylindrical member 34 and adapted to mate with a first or second housing 50, 56. The mating section 68 includes a mating base 70 having walls 72 upstanding therefrom. The mating base 70 defines an opening through which the uppermost portion of the cylindrical member 34 extends. The mating section walls 72 define openings through which bolts or pins 74 may secure the first or second housing 50, 56 to the mating section 68. At least one support member 76 is positioned underneath the mating section 68 and extends outwardly along at least a portion of the longitudinal axis of the cylindrical member 34. The support member 76 is adapted to support the mating section 68. A vertical member 40 is mounted atop the support member 76 and is adapted for mounting to the vertically oriented face portion 36 of the foundation 14. The vertical member 40 defines openings through which bolts or pins 74 may secure the bracket 30 to the foundation 14. A horizontal member 42 is pivotally connectable to the vertical member 40 and adapted for engagement with the horizontally oriented bottom portion 38 of the foundation 14. Means 44 for adjustably fitting the horizontal member 42 to the horizontally oriented bottom portion 38 is provided. If desired, the horizontal member 42 may be affixed to the bottom surface of the foundation 14 with grout at location Y. The dimensions of horizontal member 42 may be advantageously selected to suit different foundations. Thus, for example, the length of horizontal member 42 may differ, as shown in FIGS. 13 and 14. Preferably, fitting means 44 include a bolt holder 78 affixed to support member 76 which is adapted to support horizontal member 42. The bolt holder 78 defines a threaded opening 80 through which an inverted threaded bolt 82 may pass and adjustably engage the horizontal member 42.

Figure 9:
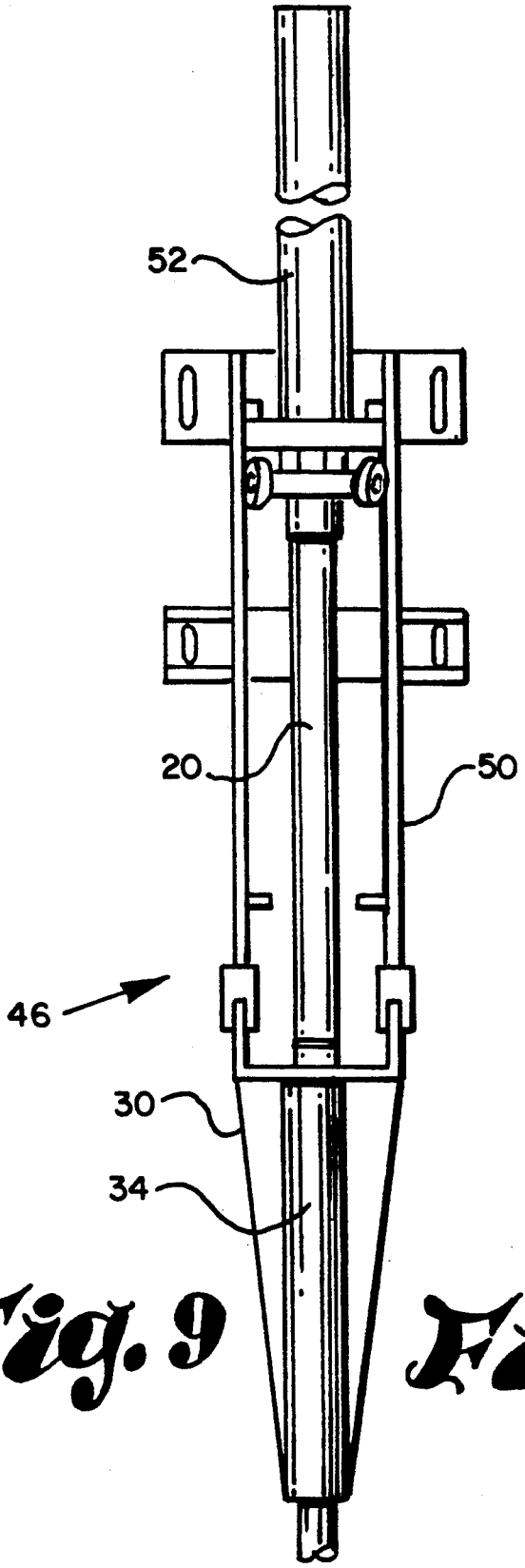
FIG. 9 is a front view of the bracket with the first housing attached thereto, illustrating the driving means assembly in position ready to drive a pier into the subsurface.
Figure 10:
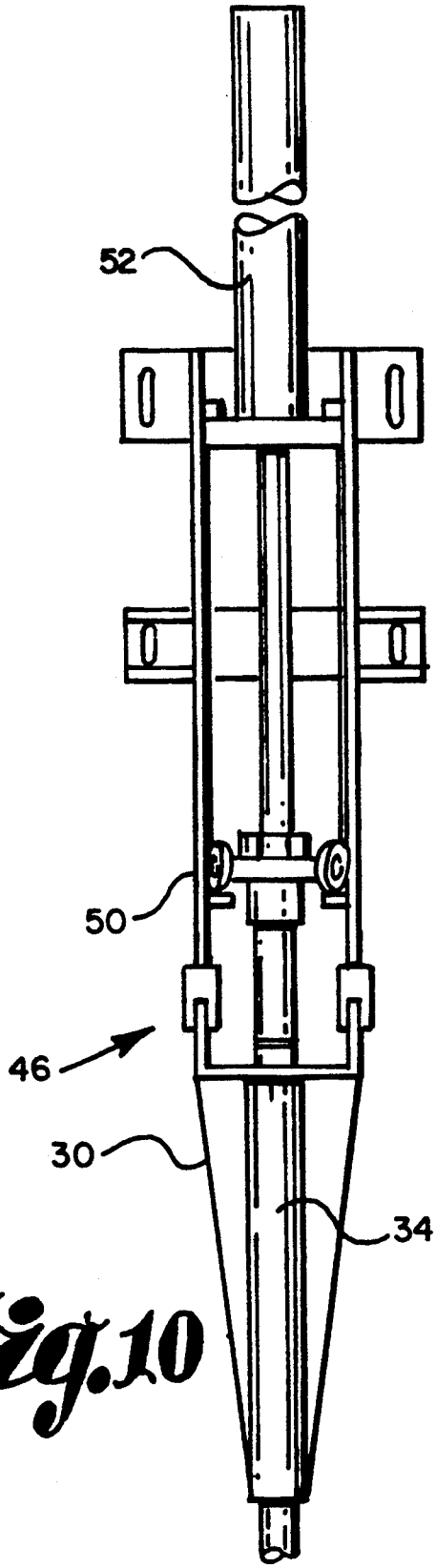
FIG. 10 is front view of the bracket with the first housing attached thereto, illustrating the driving means assembly having driven a pier into the subsurface.

FIGS. 9 and 10 illustrate preferred driving means 46 which mount to the bracket 30 and receive, hold, and drive the drivable members 20 into the subsurface 18 to a desired depth, thereby defining a set of driven members 48. A first housing 50 detachably mounts vertically atop the bracket 30 and is adapted for receiving and holding the drivable members 20 in position above the cylindrical member 34. The first housing 50 supports a first hydraulic cylinder 52 for driving the drivable members 20 into the subsurface 18 to the desired depth. The first housing 50 has walls 84, the interiors of which have tracks 86 on which the first hydraulic cylinder 52 travels. The base of first hydraulic cylinder 52 detachably mounts to a driving head 88 having a plurality of rotatably mounted runners 90 thereon. The driving head 88 is adapted to engage the end 24 of a drivable member or pier 20, 20*a*. The runners 90 engage the tracks 86 and are adapted to travel up and down the tracks 86 as the first hydraulic cylinder 52 is driven and retracted. If desired, the first housing 50 may be temporarily mounted to the structure 12 with bolts or pins 74 or other suitable means. Obviously, driving means other than hydraulic driving means may be employed, such as pneumatic driving means 66 (e.g., a jackhammer), mechanical means, or any other suitable driving means as may hereafter be developed.

Orienting means 54, shown in FIG. 11, also mount on the bracket 30 and are interchangeable with the driving means 46. Orienting means 54 lift and lower the structure 12 to a desired height. A second housing 56, interchangeable with the first housing 50, detachably mounts vertically atop the bracket 30 and is adapted to support a second hydraulic cylinder 58 for lifting and lowering the structure to the desired height. The structure of the second housing 56 is very similar to the first housing 50. However, the second hydraulic cylinder 58 employed to lift and lower the structure is shorter than the first hydraulic cylinder 52 employed for driving purposes. Thus, the second housing is correspondingly shorter, as shown in FIG. 11. In addition, the second housing 56 does not require runners 90 or tracks 86. As with driving means 46, orienting means 54 may employ mechanisms other than hydraulic mechanisms to facilitate the orientation.

Figure 2:
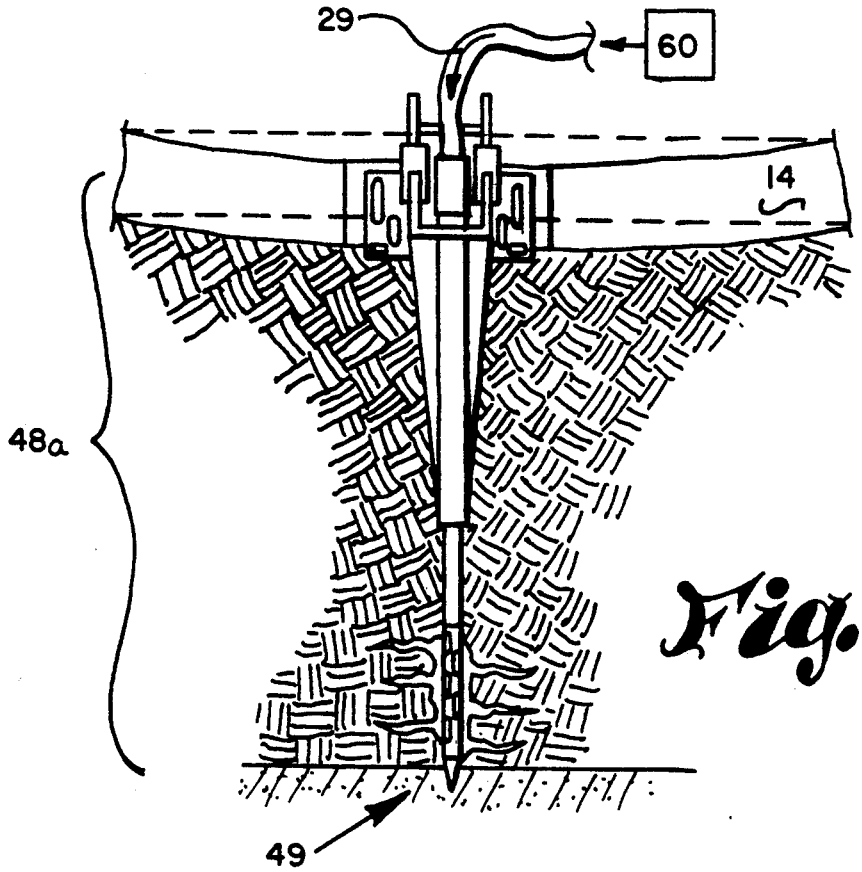
FIG. 2 is a front view of the invented earth engineering apparatus, after one or more piers have been driven into the subsurface, and start of the pressure grouting step.

Means 60 for forcing grout 29 into the uppermost end of the set of driven members 48 until a desired amount of grout 29 is formed in the subsurface 18 at the base 49 of the set of driven members 48 is also provided. See FIG. 2.

Figure 8:
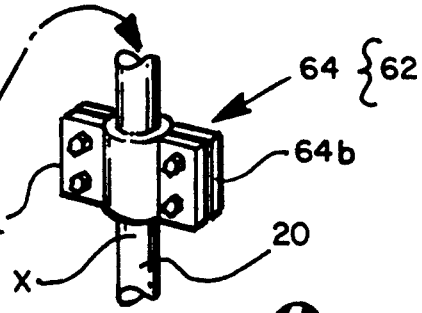
FIG. 8 is a perspective view of the collar, intended to be placed beneath the bracket, secured to a pier.

Means 62 positioned beneath and supporting the bracket 30, secured to the set of driven members 48, for locking the bracket 30 into place and securing the structure 12 is also provided. Preferably, a collar 64, as shown in FIG. 8, is positioned beneath the cylindrical member 34 and supports the bracket 30. The collar 64 is secured to the set of driven piers 48 and locks the bracket 30 into place, thereby securing the structure 12. The collar 64 includes two mating pieces 64*a*, 64*b* which surround and form a clamp around a pier 21. The two mating pieces 64*a*, 64*b* define openings through which bolts or pins 74 may pass, engage and secure the two pieces 64*a*, 64*b*.

Figure 3:
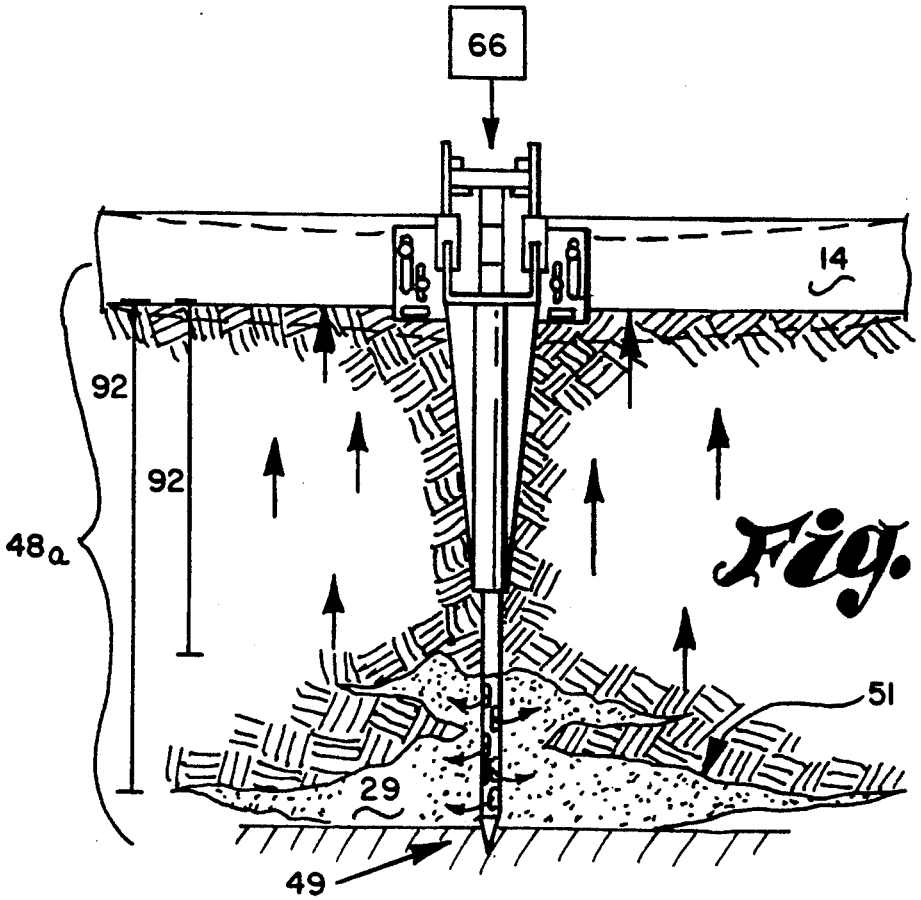
FIG. 3 is a front view of the invented earth engineering apparatus, illustrating "heaving" of the earth as the result of pressure grouting.
Figure 5:
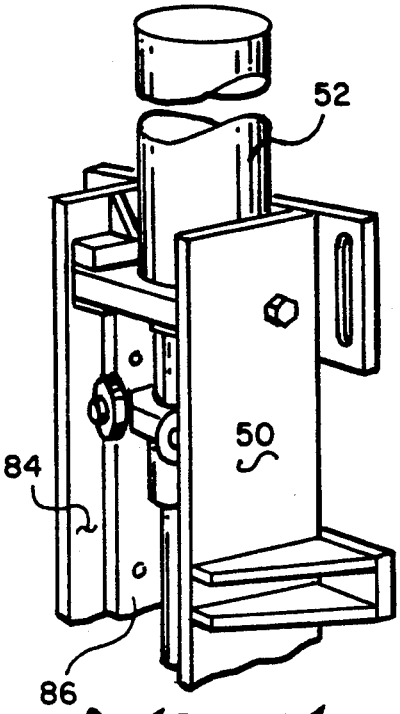
FIG. 5 is a perspective view of the driving means assembly within the first housing.
Figure 4:
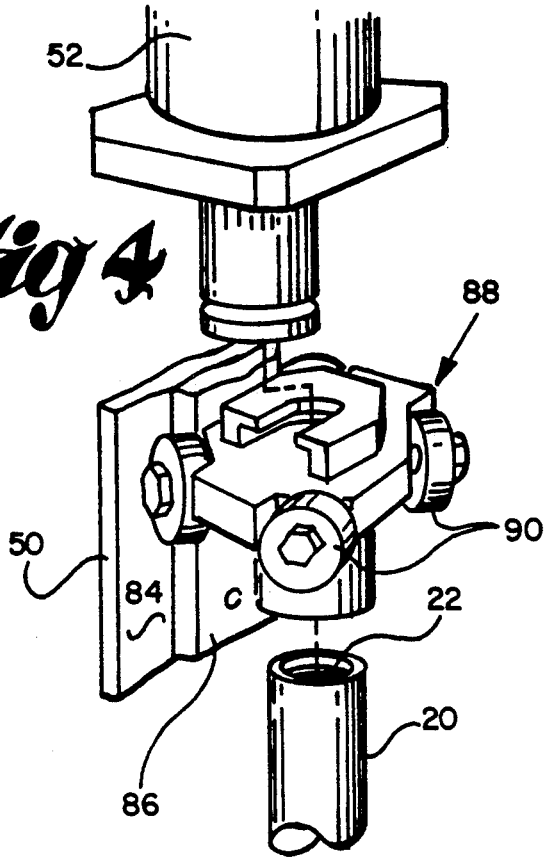
FIG. 4 is an exploded perspective view of the pier driving assembly, including the hydraulic cylinder, the driving head, a portion of the first housing, and a pier.

In operation, a portion of the subsurface 18 is removed and the foundation 14 exposed. The bracket 30 is mounted on the foundation 14 and driving means 46 mounted to the bracket 30. Drivable members 20 are consecutively driven into the subsurface 18 with driving means 46 until a desired depth is reached, thereby defining a set of driven members 48. The preferable desired depth is the point of first refusal. The drivable member 21 to be driven lowermost may be provided with a closed, tapered or pointed end 25 for facilitating entry into the subsurface 18, and may have walls 26 defining apertures 27 therein for conveying grout 29 from within the hollow interior 22 to the subsurface 18. Drivable members 20 are connected to one another prior to being driven. Each end 24 is threaded and a connector piece 26 having mating threads provides means 28 for coupling an end 24 of a drivable member 20 with an end 24 of another drivable member 20. Driving means 46 is then removed from the bracket 30. Preferably, the connected set of driven members 48 is driven further into the subsurface 18 with second driving means such pneumatic driving means 66 (e.g., a jackhammer), until the point of final refusal is reached. Grout 29 is then forced into the uppermost end 24 of the set of driven members 48 until a desired amount of grout 29 is formed in the subsurface 18 at the base 49 of the set of driven members 48. See FIG. 2. The set of driven members 48 form a load-bearing conduit, having a grout input opening at the uppermost end of the set of driven members 48, and at least one grout output opening (i.e., apertures 27) located generally at the base of the conduit. The conduit conveys grout from the surface to the subsurface. A load-bearing grout base 51 is thereby formed around the base 49 of the set of driven members 48, as shown in FIG. 3. The subsurface between the grout base 51 and the surface 16 is referred to herein as the subsurface strata 92. Grout 29 continues to be forced into the grout input opening, through the conduit or set of driven piers 48, and out of the grout output opening or apertures 27 until pressure exerted by the grout base 51 on the subsurface strata 92 forces the subsurface strata 92 upwards and lifts the foundation 14. The process of creating the grout base 51 results in permeating at least a portion of the subsurface strata 92 with grout, thereby fracturing surrounding earth, which causes an upward heaving of the subsurface strata 92. Consequently, the foundation 14 in contact with the subsurface 18 is lifted and the subsurface strata 92 is consolidated and compacted. Consolidation and compaction increases the load-bearing capacity of the subsurface strata 92. Orienting means 54 for lifting and lowering the structure 12 to a desired height is then mounted to the bracket 30. If required, the structure 12 is oriented to the desired orientation (typically such orientation being a level orientation) with orienting means 54. Grout base 51 need not, and preferably should not, be allowed to harden prior to employing orienting means 54. The driven members 48 are then secured to the bracket 30, thereby securing the structure 12. A collar 64 secures the driven member positioned immediately beneath the bracket 30 at location X. Preferably, driving means 46 and orienting means 48 are then removed the exposed foundation 14 is backfilled. Multiple apparati may be advantageously positioned around the structure 12.

SUMMARY OF THE ACHIEVEMENT OF THE OBJECTS OF THE INVENTION

From the foregoing, it is readily apparent that I have invented an improved apparatus and method for supporting and orienting a structure such as a building or house, leveling a structure that has become unlevel due to settlement of subsurface soil, providing increased stability to a structure by forming a grout base at the base of a set of driven piers affixed to the structure, and providing an apparatus capable of adjustably mounting to the foundation of a structure.

It is to be understood that the foregoing description and specific embodiments are merely illustrative of the best mode of the invention and the principles thereof, and that various modifications and additions may be made to the apparatus and method by those skilled in the art, without departing from the spirit and scope of this invention, which is therefore understood to be limited only by the scope of the appended claims.

I claim:

1. An apparatus for supporting and orienting a structure having a foundation on a surface having a subsurface, comprising:

(a) at least one drivable member, each drivable member defining a generally tubular structure having a hollow interior and open at both ends, and means for coupling an end of a drivable member with an end of another drivable member;

(b) a bracket mounted on said foundation, said bracket having means for slidably engaging said drivable members and for positioning said drivable members generally normal to said surface;

(c) driving means mountable to said bracket for receiving and holding said drivable members and for driving said drivable members into said subsurface to a desired depth, thereby defining a set of driven members;

(d) orienting means mountable on said bracket, interchangeable with said driving means, for lifting and lowering said structure to a desired height;

(e) means for forcing grout into the uppermost end of said set of driven members until a desired amount of grout is formed in said subsurface at the base of said set of driven members through a lowermost driven member, having a closed lowermost end and at least one side wall which defines at least one aperture through which grout may pass; and (f) means positioned beneath and supporting said bracket, secured to said set of driven members, for locking said bracket into place and securing said structure.

2. An apparatus for supporting and orienting a structure having a foundation on a surface having a subsurface, comprising:

(a) at least one pier, each pier defining a generally tubular structure having a hollow interior and open at both ends, and means for coupling an end of a pier with an end of another pier;

(b) a bracket mounted to said foundation, said bracket having a vertically mounted cylindrical member adapted for slidably engaging said piers and for positioning said piers generally normal to said surface;

(c) a first housing detachably mountable vertically atop said bracket adapted for receiving and holding said piers in position above said cylindrical member, and adapted to support means for driving said piers into said subsurface to a desired depth, thereby defining a set of driven piers;

(d) a second housing, interchangeable with said first housing, detachably mountable vertically atop said bracket adapted to support means for lifting and lowering said structure to a desired height;

(e) means for forcing grout into the uppermost end of said set of driven piers until a desired amount of grout is formed in said subsurface at the base of said set of driven piers; and (f) a collar positioned beneath and supporting said cylindrical member of said bracket, secured to said set of driven piers, for locking said bracket into place and further securing said structure.

3. The apparatus for supporting and orienting a structure, according to claim 2, wherein the lowermost driven pier has a closed, tapered end for facilitating entry into said subsurface, and the lowermost driven pier has at least one side wall defining apertures therein for conveying grout from within the hollow interior of the lowermost driven pier to said subsurface.

4. The apparatus for supporting and orienting a structure, according to claim 3, wherein said closed end is pointed.

5. The apparatus for supporting and orienting a structure, according to claim 3, wherein said side wall defines upwardly inclined apertures.

6. The apparatus for supporting and orienting a structure, according to claim 2, said foundation including a generally vertically oriented face portion and a generally horizontally oriented bottom portion adjacent to said vertically oriented face portion, wherein said bracket includes (a) a housing mating section mounted atop the cylindrical member and adapted to mate with said first or second housing, said mating section including a mating base having walls upstanding therefrom and defining an opening through which the uppermost portion of said cylindrical member extends, and said mating section walls defining openings through which retaining members may secure said first or second housing to said mating section;

(b) at least one support member positioned underneath said mating section and extending outwardly along at least a portion of the longitudinal axis of said cylindrical member, said support member being adapted to support said mating section;

(c) a vertical member mounted atop said support member and adapted for mounting to said vertically oriented face portion of said foundation, said vertical member defining openings through which retaining members may secure said bracket to said foundation;

(d) a horizontal member pivotally connectable to said vertical member and adapted for engagement with said horizontally oriented bottom portion of said foundation; and (e) means for adjustably fitting said horizontal member to said horizontally oriented bottom portion.

7. The apparatus for supporting and orienting a structure, according to claim 6, wherein said fitting means includes a bolt holder affixed to said support member, which defines a threaded opening through which an inverted threaded bolt may pass and adjustably engage said horizontal member.

8. The apparatus for supporting and orienting a structure, according to claim 2, wherein said first housing has walls having interiors, said wall interiors of which have tracks on which a first hydraulic cylinder travels, said first hydraulic cylinder having a base which detachably mounts to a driving head having a plurality of rotatably mounted runners thereon, said driving head being engagable with said end of said pier.

9. The apparatus for supporting and orienting a structure, according to claim 8, further comprising said runners engagable with said tracks and adapted to travel up and down said tracks.

10. The apparatus for supporting and orienting a structure, according to claim 2, wherein said driving means is hydraulic driving means.

11. The apparatus for supporting and orienting a structure, according to claim 2, wherein said lifting and lowering means is hydraulic lifting and lowering means.

12. The apparatus for supporting and orienting a structure, according to claim 2, wherein said grouting means included pressurized grouting.

13. The apparatus for supporting and orienting a structure, according to claim 2, wherein said collar includes two mating pieces which surround and form a clamp around said driven piers.

14. The apparatus for supporting and orienting a structure, according to claim 13, wherein each of said mating pieces define openings through which retaining members may pass, engage and secure said mating pieces.

15. A method for supporting and orienting a structure having a foundation on a surface having a subsurface, comprising the steps of:

(a) providing a load bearing conduit, having a grout input opening and at least one grout output opening, adapted for conveying grout from said surface to said subsurface, said grout output opening being generally located at the base of said conduit;

(b) driving said conduit into said subsurface to a point of final refusal;

(c) forcing grout into said grout input opening, through said conduit, and out of said grout output opening, thereby creating a grout base which defines a subsurface strata between said grout base and said surface, until pressure exerted by said grout base on said subsurface strata forces said subsurface strata upwards and lifts said foundation.

16. A method for supporting and orienting a structure according to claim 15, wherein said pressure exerted by said grout base on said subsurface strata compacts and consolidates said subsurface strata, whereby the load-bearing capacity of said subsurface strata is increased.

17. A method for supporting and orienting a structure according to claim 15, further comprising the step of securing said conduit to said foundation upon completion of step (c).

18. A method for supporting and orienting a structure having a foundation on a surface having a subsurface, comprising the steps of:

(a) removing a portion of said subsurface and exposing said foundation;

(b) providing at least one drivable member, each drivable member defining a generally tubular structure having a hollow interior and open at both ends, and means for coupling an end of a drivable member with an end of another drivable member;

(c) providing a bracket mounted on said foundation, said bracket having means for slidably engaging said drivable members and for positioning said drivable members generally normal to said surface;

(d) mounting said bracket to said foundation;

(e) mounting, to said bracket, driving means for receiving and holding said drivable members and for driving said drivable members into said subsurface to a desired depth;

(f) consecutively driving connected drivable members into said subsurface with said driving means until a desired depth is reached, thereby defining a set of driven members;

(g) removing said driving means from said bracket;

(h) forcing grout into the uppermost end of said set of driven members until a desired amount of grout is formed in said subsurface at the base of said set of driven members;

(i) mounting, to said bracket, orienting means for lifting and lowering said structure to a desired height;

(j) orienting said structure with said orienting means until a desired orientation is achieved; and (k) securing said driven members to said bracket thereby securing said structure.

19. A method for supporting and orienting a structure, according to claim 18, further comprising the step of providing the lowermost driven member with a closed, tapered end for facilitating entry into said subsurface, said lowermost driven member having walls defining apertures therein for conveying grout from within the hollow interior of the lowermost driven member to said subsurface.

20. A method for supporting and orienting a structure, according to claim 18, wherein said desired depth is final refusal.

21. A method for supporting and orienting a structure, according to claim 18, further comprising the step of removing said driving means and driving said set of driven members further into said subsurface with pneumatic driving means prior to step (h).

22. A method for supporting and orienting a structure, according to claim 18, wherein said step of securing said driven members to said bracket is performed by securing a collar to the driven member immediately beneath said bracket.

23. A method for supporting and orienting a structure, according to claim 18, further comprising the steps of removing said driving means and said orienting means, and backfilling said exposed foundation after step (j).

24. A method for supporting and orienting a structure according to claim 18, further comprising the step of repeating steps (a) through (j) at advantageously selected points around said structure.

25. A method for supporting and orienting a structure according to claim 18, said foundation including a generally vertically oriented face portion and a generally horizontally oriented bottom portion adjacent to said vertically oriented face portion, said bracket including a vertical member and a horizontal member pivotally connectable to said vertical member and adapted for engagement with said horizontally oriented bottom portion of said foundation, further comprising the step of inserting grout between said horizontal member and said horizontally oriented bottom portion of said foundation, after step (c), whereby said horizontal member is secured to said foundation.

* * * * *

UNITED STATES PATENT AND TRADEMARK OFFICE

CERTIFICATE OF CORRECTION

PATENT NO. : 5,123,209

DATED : June 23, 1992

INVENTOR(S) : W. T. Nalley

It is certified that error appears in the above—identified patent and that said Letters Patent is hereby corrected as shown below:

On the cover page of the Patent:

At the top, change "Nally" to -- Nalley --;

In item [76], change "Nally" to -- Nalley --.

Signed and Sealed this

Third Day of August, 1993

*Attest:*

*Attesting Officer*

Michael K. Kirk

MICHAEL K. KIRK

*Acting Commissioner of Patents and Trademarks*